US008539752B2

(12) United States Patent
Brumberg et al.

(10) Patent No.: US 8,539,752 B2
(45) Date of Patent: Sep. 24, 2013

(54) INTEGRATED DEFLAGRATION-TO-DETONATION OBSTACLES AND COOLING FLUID FLOW

(75) Inventors: Justin Thomas Brumberg, Glenville, NY (US); Adam Rasheed, Glenville, NY (US); Dustin Wayne Davis, Marlborough, CT (US)

(73) Assignee: General Electric Company, Niskayuna, NY (US)

( * ) Notice: Subject to any disclaimer, the term of this patent is extended or adjusted under 35 U.S.C. 154(b) by 528 days.

(21) Appl. No.: 12/957,047

(22) Filed: Nov. 30, 2010

(65) Prior Publication Data

US 2012/0131899 A1 May 31, 2012

(51) Int. Cl.
*F02K 5/02* (2006.01)
*F02K 7/00* (2006.01)

(52) U.S. Cl.
USPC ..... 60/247; 431/1; 60/39.38; 60/39.76

(58) Field of Classification Search
USPC ..... 60/247, 249, 39.38, 39.76; 431/1
See application file for complete search history.

(56) References Cited

U.S. PATENT DOCUMENTS 6,584,765 B1 * 7/2003 Tew et al. ..... 60/249
6,877,310 B2 4/2005 Leyva
7,047,724 B2 * 5/2006 Nordeen et al. ..... 60/226.1
7,367,194 B2 5/2008 Murayama et al.
7,669,405 B2 3/2010 Pinard et al.
7,980,056 B2 * 7/2011 Rasheed et al. ..... 60/39.83
2009/0320439 A1 * 12/2009 Chapin et al. ..... 60/39.38
2012/0144798 A1 * 6/2012 Brumberg et al. ..... 60/247
2012/0324860 A1 * 12/2012 Shimo et al. ..... 60/39.76
2013/0025256 A1 * 1/2013 Lu et al. ..... 60/204
2013/0139487 A1 * 6/2013 Kenyon et al. ..... 60/39.76

OTHER PUBLICATIONS

Ephraim Jeff Gutmark, "Duplex Tab Obstacles For Enhancement of Deflagration-to-DetonationTransition", Pending U.S. Appl. No. 12/872,693, filed Aug. 31, 2010; 30 pages.

* cited by examiner

*Primary Examiner* — William H Rodriguez
(74) *Attorney, Agent, or Firm* — Scott J. Asmus

(57) ABSTRACT

A detonation chamber and a pulse detonation combustor including a detonation chamber, wherein the detonation chamber includes a plurality of initiation obstacles and at least one injector in fluid flow communication with each of the plurality of initiation obstacles. The plurality of initiation obstacles are disposed on at least a portion of an inner surface of the detonation chamber with each of the plurality of initiation obstacles defining a low pressure region at a trailing edge. The plurality of initiation obstacles are configured to enhance a turbulence of a fluid flow and flame acceleration through the detonation chamber. The at least one injector in provides a cooling fluid flow to each of the plurality of initiation obstacles, wherein the cooling fluid flow is one of a fuel, a combination of fuels, air, or a fuel/air mixture.

24 Claims, 4 Drawing Sheets

INTEGRATED DEFLAGRATION-TO-DETONATION OBSTACLES AND COOLING FLUID FLOW

BACKGROUND

The present disclosure generally relates to cyclic pulsed detonation combustors (PDCs) and more particularly, enhancing the deflagration-to-detonation transition (DDT) process by integrating a cooling fluid flow with the initiation obstacles.

In a generalized pulse detonation combustor, fuel and oxidizer (e.g., oxygen-containing gas such as air) are admitted to an elongated detonation chamber at an upstream inlet end. An igniter is used to initiate this combustion process. Following a successful transition to detonation, a detonation wave propagates toward the outlet at supersonic speed causing substantial combustion of the fuel/air mixture before the mixture can be substantially driven from the outlet. The result of the combustion is to rapidly elevate pressure within the combustor before substantial gas can escape through the combustor exit. The effect of this inertial confinement is to produce near constant volume combustion. Such devices can be used to produce pure thrust or can be integrated in a gas-turbine engine. The former is generally termed a pure thrust-producing device and the latter is termed a pulse detonation turbine engine. A pure thrust-producing device is often used in a subsonic or supersonic propulsion vehicle system such as rockets, missiles and afterburner of a turbojet engine. Industrial gas turbines are often used to provide output power to drive an electrical generator or motor. Other types of gas turbines may be used as aircraft engines, on-site and supplemental power generators, and for other applications.

The deflagration-to-detonation (DDT) process begins when a fuel-air mixture in a chamber is ignited via a spark or other ignition source. The subsonic flame generated from the spark accelerates as it travels along the length of the chamber due to various chemical and flow mechanics. As the flame reaches critical speeds, "hot spots" are created that create localized explosions, eventually transitioning the flame to a super sonic detonation wave. The DDT process can take up to several meters of the length of the chamber, and efforts have been made to reduce the distance required for DDT by using internal initiation obstacles in the flow. The problem with obstacles for cyclic detonation devices is that they create a pressure drop within the chamber during the fill process and require cooling of the obstacles to enable long life. Initiation obstacles that include an integrated cooling system and minimize pressure drops during the fill process are desirable.

As used herein, a "pulse detonation combustor" is understood to mean any device or system that produces pressure rise, temperature rise and velocity increase from a series of repeating detonations or quasi-detonations within the device. A "quasi-detonation" is a supersonic turbulent combustion process that produces pressure rise, temperature rise and velocity increase higher than pressure rise, temperature rise and velocity increase produced by a deflagration wave. Embodiments of pulse detonation combustors include a fuel injection system, an oxidizer flow system, a means of igniting a fuel/oxidizer mixture, and a detonation chamber, in which pressure wave fronts initiated by the ignition process coalesce to produce a detonation wave or quasi-detonation. Each detonation or quasi-detonation is initiated either by external ignition, such as spark discharge or laser pulse, or by gas dynamic processes, such as shock focusing, autoignition or by another detonation (cross-fire). As used herein, a detonation is understood to mean either a detonation or quasi-detonation. The geometry of the detonation combustor is such that the pressure rise of the detonation wave expels combustion products out the pulse detonation combustor exhaust to produce a thrust force. Pulse detonation combustion can be accomplished in a number of types of detonation chambers, including shock tubes, resonating detonation cavities and tubular/tuboannular/annular combustors. As used herein, the term "chamber" includes pipes having circular or non-circular cross-sections with constant or varying cross sectional area. Exemplary chambers include cylindrical tubes, as well as tubes having polygonal cross-sections, for example hexagonal tubes.

BRIEF SUMMARY

Briefly, in accordance with one embodiment, a detonation chamber for a pulse detonation combustor is provided. The detonation chamber includes a plurality of initiation obstacles disposed on at least a portion of an inner surface of the detonation chamber, each of the plurality of initiation obstacles defining a low-pressure region at a trailing edge. The pulse detonation combustor further includes at least one injector in fluid flow communication with each of the plurality of initiation obstacles. The plurality of initiation obstacles enhance a turbulence of a fluid flow and flame acceleration through the detonation chamber. The at least one injector provides a cooling fluid flow through each of the plurality of initiation obstacles.

In accordance with another embodiment, a detonation chamber for a pulse detonation combustor is provided. The detonation chamber includes a plurality of initiation obstacles disposed on at least a portion of an inner surface of the detonation chamber and defining a low-pressure region at a trailing edge of each of the plurality of initiation obstacles. The plurality of initiation obstacles are configured to enhance a turbulence of a fluid flow and flame acceleration through the detonation chamber. The pulse detonation chamber further includes an inlet and an outlet, wherein the plurality of initiation obstacles are disposed between the inlet and the outlet and at least one injector in fluid flow communication with each of the plurality of initiation obstacles, wherein the at least one injector provides a cooling fluid flow to each of the plurality of initiation obstacles. The cooling fluid flow passes through each of the initiation obstacles and into the detonation chamber at the trailing edge of each of the initiation obstacles.

In accordance with another embodiment, a pulse detonation combustor is provided. The pulse detonation combustor includes at least one detonation chamber; an oxidizer supply section for feeding an oxidizer into the detonation chamber; a fuel supply section for feeding a fuel into the detonation chamber; and an igniter for igniting a mixture of the gas and the fuel in the detonation chamber. The detonation chamber further comprises a plurality of initiation obstacles disposed on an inner surface of the detonation chamber and defining a low pressure region at a trailing edge of each of the plurality of initiation obstacles, wherein the plurality of initiation obstacles are configured to enhance a turbulence of a fluid flow and flame acceleration through the detonation chamber; and at least one injector in fluid flow communication with each of the plurality of initiation obstacles, wherein the at least one injector provides a cooling fluid flow through each of the plurality of initiation obstacles.

These and other advantages and features will be better understood from the following detailed description of preferred embodiments of the invention that is provided in connection with the accompanying drawings.

BRIEF DESCRIPTION OF THE DRAWINGS

The above and other aspects, features, and advantages of the present disclosure will become more apparent in light of the subsequent detailed description when taken in conjunction with the accompanying drawings, wherein like elements are numbered alike in the several FIGs, and in which.

DETAILED DESCRIPTION

Figure 1:
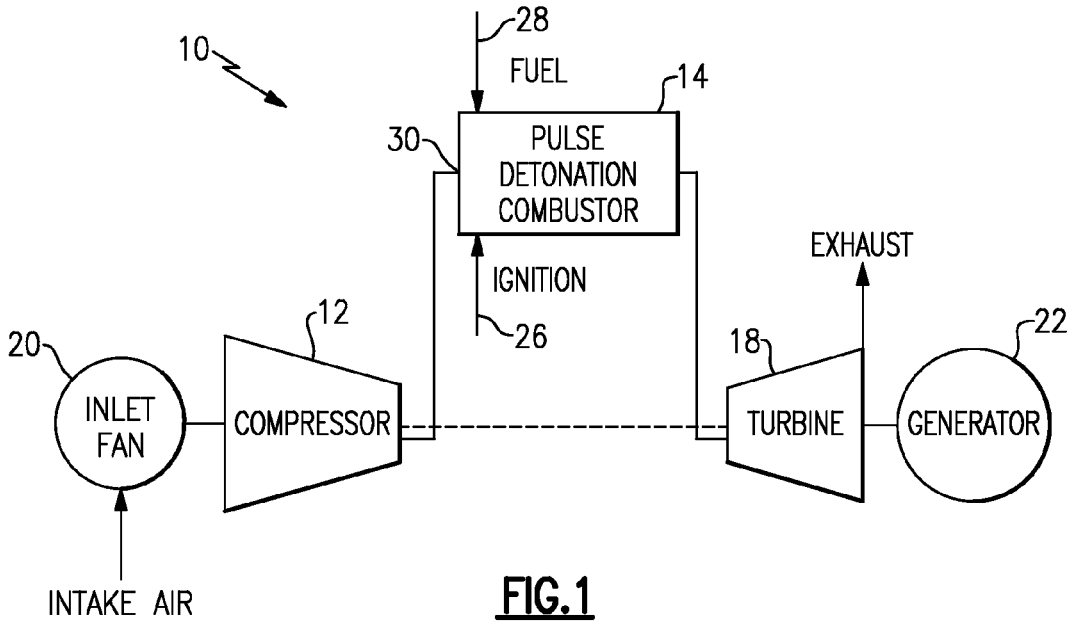
FIG. 1 is a schematic view illustrating a structure of a hybrid pulse detonation turbine engine system.
Figure 2:
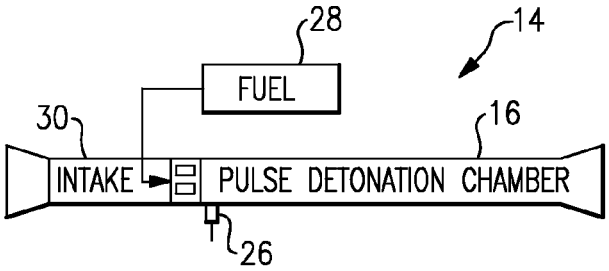
FIG. 2 is a schematic view illustrating a structure of a single detonation chamber of the pulse detonation combustor of FIG. 1.

Referring now to the drawings, one or more specific embodiments of the present disclosure will be described below. In an effort to provide a concise description of these embodiments, not all features of an actual implementation are described in the specification. Illustrated in FIGS. 1 and 2, are various pulse detonation engine systems 10 that convert kinetic and thermal energy of the exhausting combustion products into motive power necessary for propulsion and/or generating electric power. Illustrated in FIG. 1 is an exemplary embodiment of a pulse detonation combustor 14 in a pulse detonation turbine engine concept 10. Illustrated in FIG. 2 is an exemplary embodiment of a pulse detonation combustor 14 in a pure supersonic propulsion vehicle. The pulse detonation combustor 14, shown in FIG. 1 or FIG. 2, includes a detonation chamber 16 having an oxidizer supply section (e.g., an air intake) 30 for feeding an oxidizer (e.g., oxidant such as air) into the detonation chamber 16, a fuel supply section (e.g., a fuel valve) 28 for feeding a fuel into the detonation chamber 16, and an igniter (for instance, a spark plug) 26 by which a mixture of oxidizer combined with the fuel in the detonation chamber 16 is ignited.

In exemplary embodiments, air supplied from an inlet fan 20 and/or a compressor 12, which is driven by a turbine 18, is fed into the detonation chamber 16 through an intake 30. Fresh air is filled in the detonation chamber 16, after purging combustion gases remaining in the detonation chamber 16 due to detonation of the fuel-air mixture from the previous cycle. After the purging the pulse detonation combustor 16, fresh fuel is injected into pulse detonation combustor 16. Next, the igniter 26 ignites the fuel-air mixture forming a flame, which accelerates down the detonation chamber 16, finally transitioning to a detonation wave or a quasi-detonation wave. Due to the detonation combustion heat release, the gases exiting the pulse detonation combustor 14 are at high temperature, high pressure and high velocity conditions, which expand across the turbine 18, located at the downstream of the pulse detonation combustor 16, thus generating positive work. For the pulse detonation turbine engine application with the purpose of generation of power, the pulse detonation driven turbine 18 is mechanically coupled to a generator (e.g., a power generator) 22 for generating power output. For a pulse detonation turbine engine application with the purpose of propulsion (such as the present aircraft engines), the turbine shaft is coupled to the inlet fan 20 and the compressor 12. In a pure pulse detonation engine application of the pulse detonation combustor 14 shown in FIG. 2, which does not contain any rotating parts such as a fan or compressor/turbine/generator, the kinetic energy of the combustion products and the pressure forces acting on the walls of the propulsion system, generate the propulsion force to propel the system.

Figure 3:
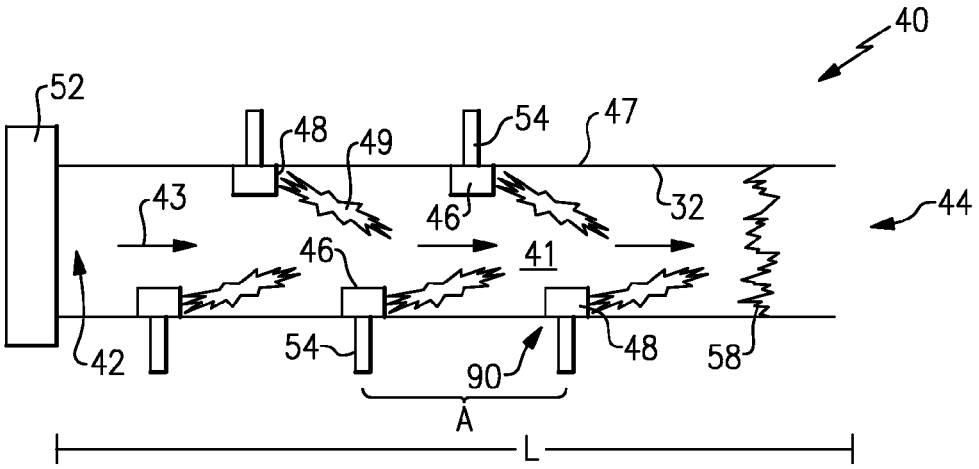
FIG. 3 is a schematic view illustrating an improved pulse detonation combustor in accordance with exemplary embodiments.

Turning now to FIGS. 3-7, illustrated are schematic views of alternate embodiments of an improved pulse detonation combustor. The schematic views illustrate an inside of an improved detonation chamber, generally similar to detonation chamber 16 of FIG. 2, by removing the top 50% of the chamber, or tube, surface. More specifically, illustrated in FIG. 3 is an improved pulse detonation combustor, generally depicted as 40, similar to the pulse detonation combustor 14 of FIGS. 1 and 2. The improved pulse detonation combustor 40 is illustrated having a detonation chamber 41 defined by sidewalls 47. The improved detonation chamber 41 includes an inlet 42 and an outlet 44, through which a fluid flows from upstream towards downstream, as indicated by the directional arrows 43. The improved detonation chamber 41 also includes a plurality of initiation obstacles 46 for deflagration-to-detonation transition. The initiation obstacles 46 may be disposed on an inner surface 32 of the improved detonation chamber 41 and extend into the detonation chamber 41. Alternately, the initial obstacles 46 may be formed integral with the detonation chamber sidewalls 47. The pulse detonation combustor 40 may further include proximate the inlet 42 of the detonation chamber 41, an air intake valve 52.

In the embodiment depicted in FIG. 3, each of the plurality of initiation obstacles 46 includes an integrated injector 54 configured for the injection of a cooling fluid flow 49 into the detonation chamber 41. In this exemplary embodiment, provided are a plurality of injectors 54 configured to aid in supplying a proper fuel-to-air mixture to the detonation chamber 41. Each of the plurality of injectors 54 provides the injection of fuel through the initiation obstacle 46 to which it is integrated. By integrating the injection, and thus supply, of fuel with the initiation obstacles 46, the fuel may be used as the cooling fluid flow 49 to maintain an appropriate temperature of each initiation obstacle 46. The integration of the injection of the cooling fluid flow 49 with the initiation obstacles 46 minimizes the need for a secondary cooling airflow path dedicated to the initiation obstacles 46 and at the same time creates viable locations for fuel injection into the detonation chamber 46. Injection of the required fuel for the combustion process through the initiation obstacles 46 provides for cooling of the initiation obstacles 46 to improve longevity and reduce maintenance cycles. In addition, by injecting the fuel through each of the initiation obstacles 46 the fuel is spread out over an entire length "L" of the detonation chamber 41. The initiation obstacles 46 create turbulence in the flow, so by injecting the fuel at these locations, the fuel is introduced at locations of high mixing.

The injectors 54 are positioned to inject a fluid flow 49, which in this particular embodiment is fuel, at a trailing edge 48 of each obstacle 46 where a low-pressure region is created during a fill process. The injection of fuel at the trailing edge 48 of the obstacles 46 enables the low-pressure region to be reduced during the fill process. By reducing this low-pressure region, the filling losses in the detonation chamber 41 are reduced.

In order to ensure the proper mixture of fuel and air in the detonation chamber 41, the injection of the fluid flow 49 through the obstacles 46 will need to be controlled, including, but not limited to, staging of the injection, timing of the injection and duration of the injection. In an exemplary embodiment, the injection of the fluid flow 49 will be pulsed and timed with the frequency of combustor operation (air valve, ignition source, etc.). For pulsed applications the injectors 54 can be timed together, staged, or operated individually to achieve the desired fuel-to-air mixture.

The plurality of integrated initiation obstacles 46 and injectors 54 are disposed on the inner surface 32 of the improved detonation chamber 41 to enhance and accelerate the turbulent flame speed, while limiting the total pressure loss in the pulse detonation combustor 40 and providing cooling to the initiation obstacles 46 for durability. The plurality of initiation obstacles 46 also enhance turbulence flame surface area by providing increased turbulence which allow the flame front to stretch at a greater rate compared to the flame surface area in a combustor chamber with smooth walls. A plurality of circumferentially and axially spaced apart integrated initiation obstacles 46 and injectors 54 were found to be necessary in the illustrated embodiments to affect the transition of the accelerating turbulent flame into a detonation wave 58.

Figure 4:
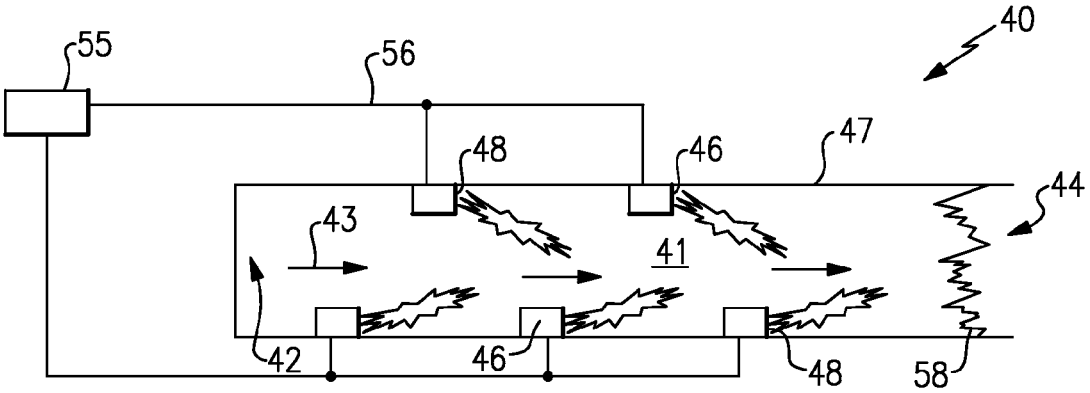
FIG. 4 is a schematic view illustrating an improved pulse detonation combustor in accordance with exemplary embodiments.

As previously described, the embodiment depicted in FIG. 3, integrates a single injector 54 with each of the plurality of initiation obstacles 46. Referring now to FIG. 4, illustrated is an alternate embodiment of an improved pulse detonation combustor, generally depicted as 50, and similar to pulse detonation combustor 40 of FIG. 3. For ease of illustration, the same numerals may be used to indicate similar elements in the figures. In this exemplary embodiment, and in contrast to the embodiment of FIG. 3, the pulse detonation combustor 40 includes a single fuel modulator, or injector, 55 that is integrated with two or more of the initiation obstacles 46. More specifically, as illustrated a single injector 55 is integrated and in fluidic communication via fluid lines 56 with at least two or more of the plurality of initiation obstacles 46. Alternatively, more than one injector 55 may be included wherein each is integrated with two or more initiation obstacles 46. The initiation obstacles 46 and injector 55 are integrated as previously described with regard to FIG. 3 so as to deliver a cooling fluid flow 49 at a trailing edge 48 of each of the initiation obstacles 46 and operate in a similar manner. The integration of a single injector/modulator 55, or more than one initiation obstacle 46 per injector 55, provides for a pulse detonation combustor 40 in which less system components are required.

Figure 5:
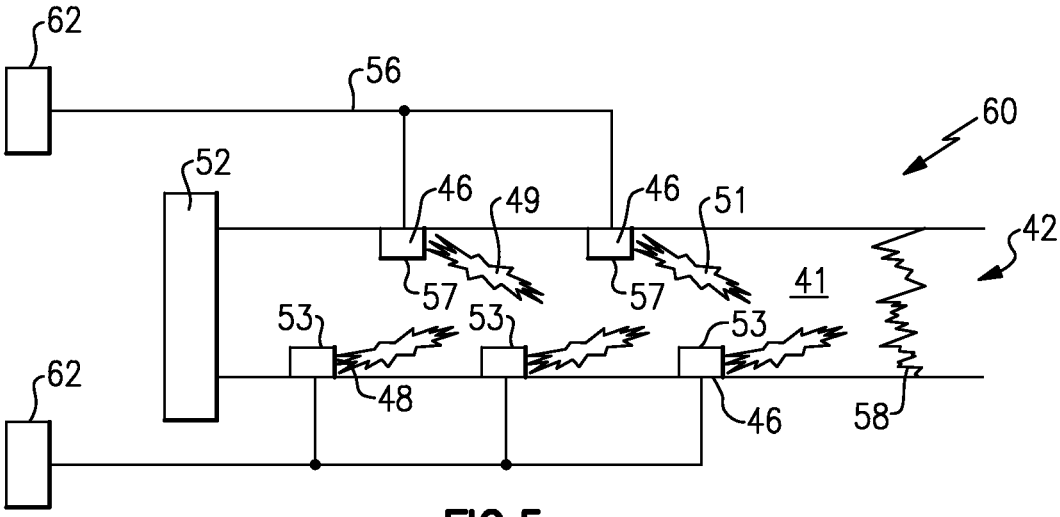
FIG. 5 is a schematic view illustrating an improved pulse detonation combustor in accordance with exemplary embodiments.

Referring now to FIG. 5, illustrated is an alternate embodiment of an improved pulse detonation combustor, generally depicted 60, and similar to pulse detonation combustor 40 of FIG. 3. In the embodiment illustrated in FIG. 5, the integrated initiation obstacle and fuel injector system provide for the injection of a fluid flow 49 that includes both fuel and air. More specifically, in contrast to the previously disclosed embodiment, provided is the injection of a fluid flow 49 that includes a flow 51 of both air and fuel. The flow 51 is injected though a plurality of integrated initiation obstacles 46 and a plurality of injectors 62 via fluidic communications 56. It should be noted that, illustrated are a plurality of injectors 62 configured in fluidic communication with a first set of initiation obstacles 53 and a second set of initiation obstacles 57. Alternately, the injection of the flow 51 of fuel and air may be accomplished by fewer or greater numbers of injectors, such as configurations similar to the described embodiments illustrated in FIGS. 3 and 4.

The plurality of injectors 62 are configured to inject the flow 51 of the fuel and air mixture into the detonation chamber 41 at a trailing edge 48 of each initiation obstacle 46. In this exemplary embodiment, the individual flows of the fuel and air may be configured on separate circuits or injected in a spray blast atomization configuration. When injecting the fuel and air on separate circuits, the equivalence ratio can be tailored along the length of the detonation chamber 41 (for example: phi=1 at head end→phi=0.7 at aft) by changing the injection timing/duration for each individual injector 62. The spray blast enables creation of the proper droplet size for liquid fuels and therefore may be advantageous. In an alternate embodiment, the integrated initiation obstacles 46 and injectors 62 may be configured to inject more than one type of fuel through a single injector 62. The injection of more than one type of fuel, such as a gaseous fuel and a liquid fuel, may allow for ease in detonation.

Figure 6:
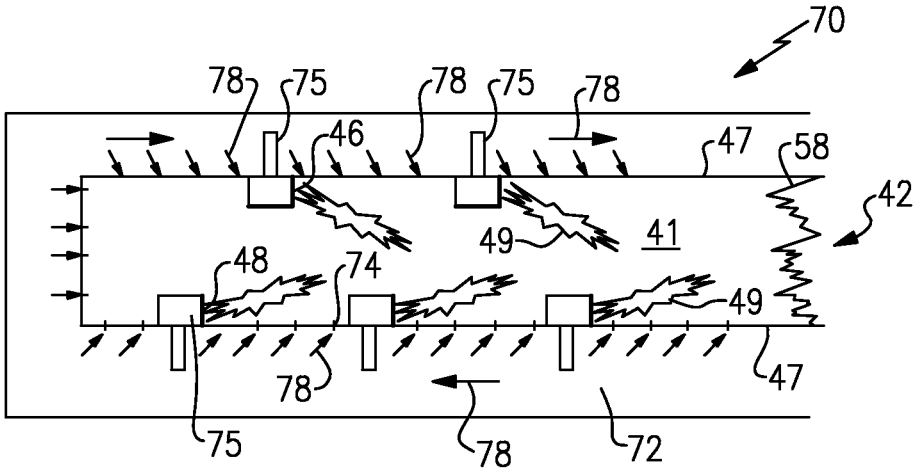
FIG. 6 is a schematic view illustrating an improved pulse detonation combustor in accordance with exemplary embodiments.

Referring now to FIG. 6, illustrated is an alternate embodiment of an improved pulse detonation combustor, and more particularly an integrated initiation obstacle and cooling fluid injector, generally depicted as 70. System 70 is generally similar to pulse detonation combustor 40 of FIG. 3. In the embodiment illustrated in FIG. 6, the detonation chamber 41 is surrounded by a plenum 72 providing a flow of air 78 to the detonation chamber 41. More specifically, the plenum 72 supplies the flow of air 78 to the detonation chamber 41 via a plurality of openings 74 formed in the sidewall 47 of the detonation chamber 41. A cooling fluid flow 49, such as a gaseous and/or liquid fuel, is injected though a plurality of integrated initiated obstacles 46 and injectors 75, similar to the embodiment illustrated in FIG. 3. It should be noted that, while a plurality of injectors 75 are illustrated, with each injector 75 integrated with a single initiation obstacle 46, a fewer number of injectors/modulators each configured integral with two or more initiation obstacles 46, such as that illustrates in FIGS. 4 and 5, is anticipated.

The plurality of injectors 75 are configured to inject the cooling fluid flow 49 into the detonation chamber 41 at a trailing edge 48 of each initiation obstacle 46. The injection of the flow of air 78 via plenum 72 and openings 74, is distributed substantially equally along an entire surface of the detonation chamber 41 with the cooling fluid flow 49 being injected simultaneously along the chamber 41. The distributed airflow 78 injection via openings 74 provides a faster fill of the chamber 41 so as to reduce fill time and enable higher frequency operation of the pulse detonation combustor 70.

Figure 7:
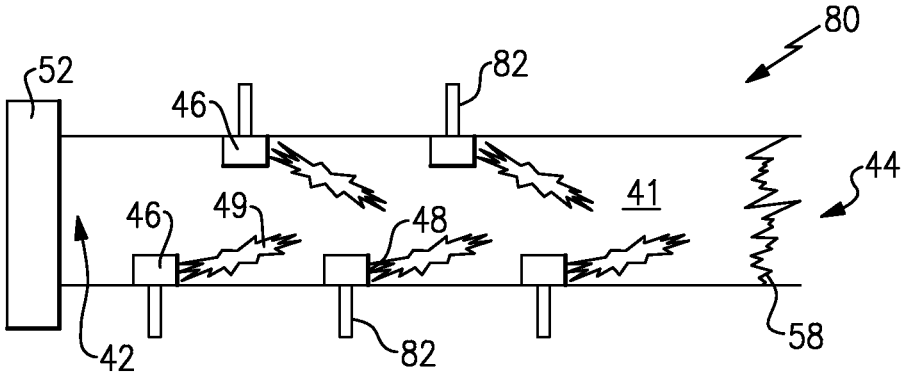
FIG. 7 is a schematic view illustrating an improved pulse detonation combustor in accordance with exemplary embodiments.

Referring now to FIG. 7, illustrated is an alternate embodiment of an improved pulse detonation combustor, generally depicted 80. In contrast to the previously disclosed pulse detonation combustors in which the cooling fluid flow 49 included fuel or a fuel/air mixture, in this exemplary embodiment only air is injected though a plurality of integrated initiated obstacles 46 and injectors 82. It should be noted that, illustrated are a plurality of injectors 82 each configured in fluidic communication and integral a single initiation obstacles 46. Alternately, the injection of the air may be accomplished by fewer or greater numbers of injectors, such as configurations similar to the described embodiments illustrated in FIGS. 3 and 4.

The plurality of injectors 82 are configured to inject air into the detonation chamber 41 at a trailing edge 48 of each initiation obstacle 46. In this exemplary embodiment, the air may be pulsed or steady and operates to cool the initiation obstacles 46. Fuel injection into the detonation chamber 41 would occur separate from injectors 82.

In each of the embodiments illustrated in FIGS. 3-7, the plurality of initiation obstacles 46 may be arranged as depicted and disposed in any number of rows and columns. More specifically, the columns may be spaced axially along the improved detonation chamber 41, and the rows may be spaced circumferentially along the improved detonation chamber 41. Additionally, the number of rows and columns and the spacing between each may be varied to achieve detonations or quasi-detonations in varying fuel-air systems. In other exemplary embodiments, the plurality of integrated initiation obstacles 46 and injectors may be disposed in a number of rows and columns and having staggered or inline arrangement along the axial direction. In further exemplary embodiments, the plurality of integrated initiation obstacles 46 and injectors may have varying density on the interior surface 32 of the detonation chamber 41. In the exemplary embodiments illustrated in FIGS. 3-7, the plurality of integrated initiation obstacles 46 and injectors are disposed in one or more circumferential arrays 90 (FIG. 3), each including the plurality of integrated initiation obstacles 46 and injectors wherein each circumferential array 90 is axially spaced as indicated at "A", relative to another circumferential array 90, along at least a portion of the inner surface 32 of the detonation chamber 41 from the inlet 42 to the outlet 44. The plurality of integrated initiation obstacles 46 and injectors may have various possible configurations within the detonation chamber 41, further including odd as well as even numbers thereof; unequal as well as equal circumferential spacing; and unequal as well as equal size, geometry, and position of the initiation obstacles 46 around the inner surface 32 of the detonation chamber 41 as desired to enhance deflagration-to-detonation transition (DDT), minimize aerodynamic performance losses and provide an integrated cooling system to the initiation obstacles 46.

Referring still to FIGS. 3-7, the plurality of the plurality of integrated initiation obstacles 46 and injectors may be disposed in a wide variety of arrangements on the inner surface 32 of the detonation chamber 41, between the inlet 42 and the outlet 44. In the exemplary embodiments, the initiation obstacles 46 are arranged in corresponding rows in the detonation chamber 41 in single planes along a length of the detonation chamber 41.

The improved detonation chamber 41 may be constructed in a variety of ways including, but not limited to, casting, welding or molding initiation obstacles 46 to form the structures protruding from the surface 32 of the detonation chamber 41 and having integrated therewith the injectors. The plurality of initiation obstacles 46 may be formed as commonly used DDT geometries such as spirals, regularly spaced blockage plates, or as shaped walls. These various configurations are shown in the FIGs. as an expedient of presentation only, and actual use and design of the various initiation obstacles 46 will depend on actual combustor design and aerodynamic cycles.

Accordingly, by the introduction of relatively simple and small initiation obstacles on an interior surface of the detonation chamber between the inlet and the outlet and having integrated therewith at least one injector for the injection of cooling fluid flow, such as a fuel, a combination of fuels, a fuel/air mixture, or air, provides: (i) significant enhancement in the turbulence of the fluid flow within the detonation chamber; (ii) enhancement of the deflagration-to-detonation transition; (iii) cooling of the initiation obstacles; (iv) minimization of pressure drops during the fill process; and (v) creates viable locations for fuel injection into the detonation chamber. The integrated initiation obstacles and injectors may have various configurations represented by various permutations of the various features described above as examples.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A detonation chamber for a pulse detonation combustor comprising:

a plurality of initiation obstacles disposed on at least a portion of an inner surface of the detonation chamber, each of the plurality of initiation obstacles defining a low-pressure region at a trailing edge; and at least one injector in fluid flow communication with each of the plurality of initiation obstacles, wherein the plurality of initiation obstacles enhance a turbulence of a fluid flow and flame acceleration through the detonation chamber; and wherein the at least one injector provides a cooling fluid flow through each of the plurality of initiation obstacles.

2. The detonation chamber of claim 1, further comprising an inlet and an outlet, wherein the plurality of initiation obstacles are disposed on at least a portion of an inner surface of the detonation chamber between the inlet and the outlet.

3. The detonation chamber of claim 1, wherein the cooling fluid flow enters the detonation chamber at the trailing edge of each of the plurality of initiation obstacles.

4. The detonation chamber of claim 1, further comprising a plurality of openings formed in a sidewall of the detonation chamber and configured to provide for the passage therethrough of a flow of air.

5. The detonation chamber of claim 1, wherein the cooling fluid flow is at least one of a gaseous fuel, a liquid fuel, or air.

6. The detonation chamber of claim 1, wherein the at least one injector includes a plurality of injectors, each configured in fluid flow communication with at least one initiation obstacle.

7. The detonation chamber of claim 6, wherein each of the plurality of injectors is configured in fluid flow communication with two or more of the plurality of initiation obstacles.

8. The detonation chamber of claim 1, wherein the at least one injector includes a plurality of injectors, wherein each of the plurality of initiation obstacles is integrally formed with one of the plurality of injectors.

9. The detonation chamber of claim 1, wherein the at least one injector is in fluid flow communication with the plurality of initiation obstacles via a fluid flow line.

10. The detonation chamber of claim 1, wherein said plurality of initiation obstacles are circumferential spaced apart along at least a portion of the inner surface of the detonation chamber.

11. The detonation chamber of claim 10, wherein said circumferential spaced apart plurality of initiation obstacles are disposed in one or more circumferential arrays axially spaced along at least a portion of the inner surface of the detonation chamber.

12. A detonation chamber for a pulse detonation combustor comprising:

a plurality of initiation obstacles disposed on at least a portion of an inner surface of the detonation chamber and defining a low pressure region at a trailing edge of each of the plurality of initiation obstacles, wherein the plurality of initiation obstacles are configured to enhance a turbulence of a fluid flow and flame acceleration through the detonation chamber;

an inlet and an outlet, wherein the plurality of initiation obstacles are disposed between the inlet and the outlet; and at least one injector in fluid flow communication with each of the plurality of initiation obstacles, wherein the at least one injector provides a cooling fluid flow to each of the plurality of initiation obstacles, wherein the cooling fluid flow passes through each of the initiation obstacles and into the detonation chamber at the trailing edge of each of the initiation obstacles.

13. The detonation chamber of claim 12, wherein the cooling fluid flow is at least one of a gaseous fuel, a liquid fuel, or air.

14. The detonation chamber of claim 12, wherein the at least one injector includes a plurality of injectors, each configured in fluid flow communication with at least one of the plurality of initiation obstacles.

15. The detonation chamber of claim 12, wherein each of the plurality of injectors is configured in fluid flow communication with two or more of the plurality of initiation obstacles.

16. The detonation chamber of claim 12, wherein the at least one injector includes a plurality of injectors, wherein each of the plurality of initiation obstacles is integrally formed with one of the plurality of injectors.

17. The detonation chamber of claim 12, wherein the plurality of initiation obstacles are circumferentially and axial spaced apart between said inlet and said outlet.

18. A pulse detonation combustor comprising:

at least one detonation chamber;

an oxidizer supply section for feeding an oxidizer into the detonation chamber;

a fuel supply section for feeding a fuel into the detonation chamber; and an igniter for igniting a mixture of the gas and the fuel in the detonation chamber, wherein said detonation chamber comprises:

a plurality of initiation obstacles disposed on an inner surface of the detonation chamber and defining a low pressure region at a trailing edge of each of the plurality of initiation obstacles, wherein the plurality of initiation obstacles are configured to enhance a turbulence of a fluid flow and flame acceleration through the detonation chamber; and at least one injector in fluid flow communication with each of the plurality of initiation obstacles, wherein the at least one injector provides a cooling fluid flow through each of the plurality of initiation obstacles.

19. The pulse detonation combustor of claim 18, further comprising a plenum surrounding the detonation chamber and configured for the passage of an airflow therethrough.

20. The pulse detonation combustor of claim 18, wherein the detonation chamber further comprises an inlet and an outlet, wherein the plurality of initiation obstacles are disposed between the inlet and the outlet.

21. The pulse detonation combustor of claim 18, wherein the plurality of initiation obstacles are circumferentially and axial spaced apart between said inlet and said outlet.

22. The detonation chamber of claim 18, wherein the cooling fluid flow is at least one of a gaseous fuel, a liquid fuel, or air.

23. The detonation chamber of claim 18, wherein the at least one injector includes a plurality of injectors, each configured in fluid flow communication with at least one of the plurality of initiation obstacles.

24. The detonation chamber of claim 23, wherein each of the plurality of injectors is configured in fluid flow communication with two or more of the plurality of initiation obstacles.

* * * * *